United States Patent [19]

Beamer et al.

[11] Patent Number: 4,881,594

[45] Date of Patent: Nov. 21, 1989

[54] HEADER PLATE FOR PRESSURE VESSELS, HEAT EXCHANGERS AND THE LIKE

[75] Inventors: Henry E. Beamer, Middleport; William J. Buchanan, Olcott, both of N.Y.

[73] Assignee: General Motors Corporation, Detroit, Mich.

[21] Appl. No.: 328,913

[22] Filed: Mar. 27, 1989

[51] Int. Cl.[4] ..... F28F 9/02

[52] U.S. Cl. ..... 165/173; 165/83

[58] Field of Search ..... 165/148, 149, 173, 175, 165/83

[56] References Cited

U.S. PATENT DOCUMENTS 4,234,041 11/1980 Melnyk ..... 165/173
4,485,867 12/1984 Melnyk et al. ..... 165/173
4,582,127 4/1986 Moranne ..... 165/83

FOREIGN PATENT DOCUMENTS 2036398 2/1971 Fed. Rep. of Germany ..... 165/173

*Primary Examiner*—Martin P. Schwadron
*Assistant Examiner*—Allen J. Flanigan
*Attorney, Agent, or Firm*—Ronald L. Phillips

[57] ABSTRACT

A heat exchanger header plate has a first set of strengthening ribs each located between adjacent tube slots which are formed in a second set of ribs that extend oppositely to the ribs in the first set.

6 Claims, 1 Drawing Sheet

HEADER PLATE FOR PRESSURE VESSELS, HEAT EXCHANGERS AND THE LIKE

TECHNICAL FIELD

This invention relates to heat exchanger headers and more particularly to header rib reinforcement therein.

BACKGROUND OF THE INVENTION

It is common practice to increase the strength of the overhangs of header plates used on pressure vessels and heat exchangers by adding rib patterns to the plates rather than increasing their gage (thickness). For example, the typical header on a motor vehicle radiator made of aluminum with flat sided tubes has a plurality of bumps formed in the header each with a pierced tube slot. The latter provides a joint surface for the tube header joint, lead in to assist or guide inserting the tube into the tube slot and increased header stiffness in the tube to header joint area. The tank is attached to the header by means of a gasketed clinch joint or brazing and the region between the tube bumps and the tank to header clinch joint is referred to as the header overhang. And it is the header overhang that is subjected to bending loads resulting from internal pressure in the radiator with such bending loads increasing proportionally with the length of the overhang and the resulting deformations increasing with the cube of the length of the overhang. Thus, radiators utilizing a large overhang would require heavy gage headers to resist the resulting bending loads. For this reason, and to avoid increasing the header gage, ribs ar formed in the header overhang region to increase the header strength and thereby minimize the header gage required. Normally, such ribs are located between the tube slots and formed in the opposite direction of the tube bumps. That is, the tube bumps normally project upward from the liquid side of the header plate and the reinforcement ribs project in the opposite direction from the air side of the header plate. While this has proven generally satisfactory, the degree of ribbing possible is controlled by the formability of the header material. For example, such conventional ribbing works well for moderate overhang lengths but can be only marginally effective with the large overhangs required by some applications where the width of the tank is substantially greater than the corresponding dimension of the flat tubes.

SUMMARY OF THE INVENTION

According to the present invention, there is provided a strength enhancing rib pattern in which the ribs project in both directions from the header by simply extending the tube bumps to also each define a rib in addition and in opposite directional sense to the conventional rib formed between adjacent tube bumps. By forming ribs in both directions, the effective rib height is increased resulting in a substantial increase in header strength. Moreover, the formability of the header is also enhanced allowing deeper ribs to be formed. Furthermore, such improved rib pattern not only increases header stiffness, it reduces the stresses significantly as compared with monodirectional ribs. And it will also be appreciated that with the increased strength that results, the material gage of a current header design can thus be reduced significantly. In addition, such increased strength enhances the processing of the headers during headering, brazing and clinching operations. A still further advantage is that the improved rib pattern also provides increased guiding for inserting the tubes into the header.

These and other objects, advantages and features of the present invention will become more apparent from the following description and drawing in which:

DESCRIPTION OF THE PREFERRED EMBODIMENT

Figure 1:
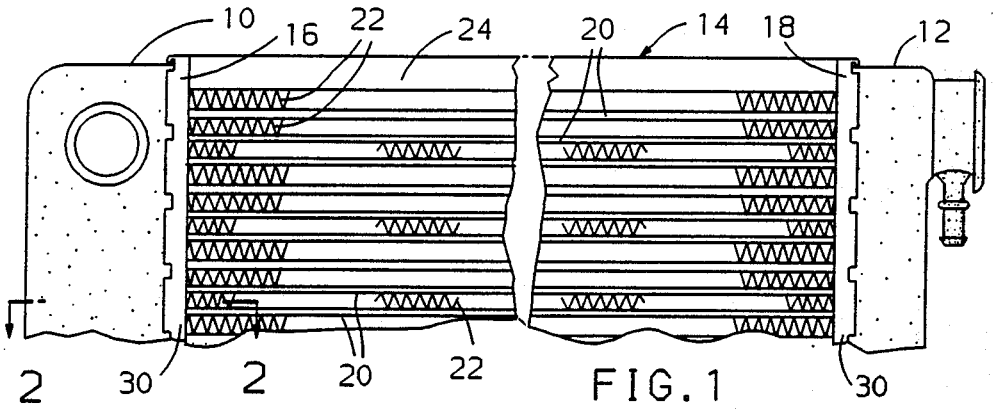
FIG. 1 is a frontal view of the upper portion of a motor vehicle radiator having header plates constructed according to the present invention.
Figure 2:
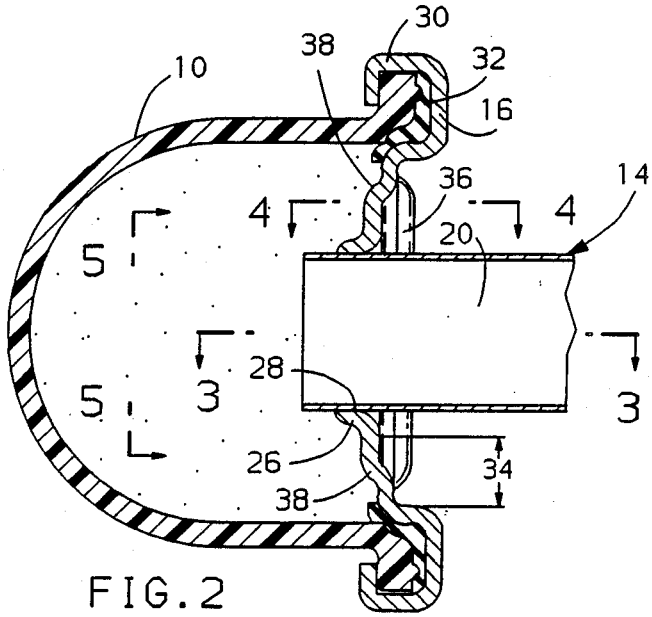
FIG. 2 is an enlarged view taken on the line 2—2 in FIG. 1.
Figure 3:
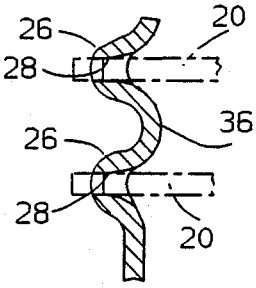
FIG. 3 is a view of the left hand header taken on the lines 3—3 in FIG. 2.
Figure 5:
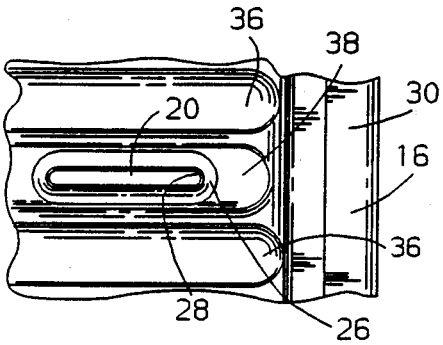
FIG. 5 is a view taken on the lines 5—5 in FIG. 2.

Referring to FIG. 1, there is shown a motor vehicle radiator comprising a pair of plastic tanks 10 and 12 and an aluminum core 14 which joins the tanks. The core 14 comprises a pair of header plates 16 and 18 which are clinched to the respective tanks 10 and 12 and to which are brazed a plurality of flat sided tubes 20 with strips of corrugated and louvered fins 22 inserted between and brazed to adjacent tubes 20. In addition, there is provided a reinforcement member 24 at each side of the core (only the upper one being shown) which is brazed to the outermost fin strip and at its ends to the respective headers.

The headers 16 and 18 are stamped from plate stock and as seen in FIGS. 2–5, tube bumps 26 are formed in each of the headers each with a pierced tube slot 28 to receive a respective tube 20 and align all of the latter in a row across the core. The piercing is accomplished from the air side of the header plate so as to provide a lead in to assist in inserting the tube into the tube slot and to increase header stiffness in the tube to header joint area. Each of the tanks 10 and 12 as shown with respect to the tank 10 is attached to its respective header by means of a clinched joint 30 which is sealed with a gasket 32 positioned between the tank and header plate. The region 34 along both sides of the row of tubes between the tube bumps and the tank to header clinch joint is the header overhang. And it is this header overhang which is outward of the region containing the tube slots that is subjected to bending loads resulting from internal pressure in the radiator during engine operation.

Figure 4:
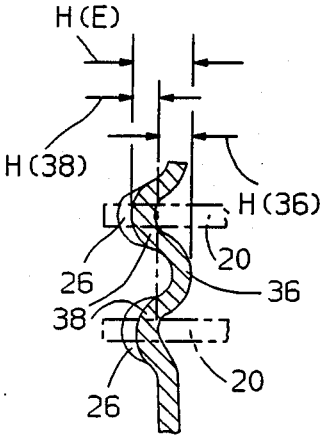
FIG. 4 is a view taken on the lines 4—4 in FIG. 2.

The strength of the header plates is enhanced according to prior practice by a first set of ribs 36 which are located parallel to each other and between adjacent tube slots 28 and extend alongside thereof and substantially across the overhang 34. The ribs 36 are channel shaped and are formed in the opposite direction of the tube bumps 26. That is, the tube bumps 26 are formed outwardly from the liquid side of the header plates while the reinforcement ribs 36 are formed oppositely therefrom from the air side of the header plates with a concave side on the liquid side and a convex side on the air side. According to the present invention, the header plates are further reinforced by extending the tube bumps 26 so as to also each form a rib 38 outward from the liquid side of the header plate in addition to the ribs 36 formed in the opposite direction between the tube bumps. Also, the additional ribs 38 are parallel to each other and to the other ribs 36 and also are channel shaped but with their concave side on the air side of the header plate and their convex side on the liquid side. And, as a result, the tube slots 28 are defined by their respective slotted bumps 26 now forming a tube receiving collar integral with the respective strengthening ribs 38 and extending outward from the liquid side. Moreover, it will be seen that the additional ribs 38 also extend substantially the length of the overhang the same as the oppositely directed ribs 36 and thus substantially the width of the header plate between the clinch joint. And given the amount of deformability allowed, the added ribs 38 have a height H(38) that can be made equal to the height H(36) of the other ribs 36 so that the effective rib height H(E) is effectively doubled as seen in FIG. 4 resulting in a very significant increase in header strength. However, it will also be understood that the height of the added ribs 38 need not be made equal as the important concept is that the heights of the ribs 36 and 38 are additive. Moreover, it will also be appreciated that the height of both sets of ribs can be reduced from the maximum permissible to provide increased header stiffness but yet significantly reduce stress as compared to a header plate without the additional ribs 38. Furthermore, it will be appreciated that while the radiator shown has only a single row of tubes, it may have two or more such rows of tubes spaced along the depth of the core inboard of the overhang.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles and its practical application to thereby enable one of ordinary skill in the art to utilize the invention in various embodiments and with various modifications as are suited to the particular use contemplated. For example, the invention is applicable to air to air and liquid to liquid heat exchangers as well as the liquid to air heat exchanger shown and is thus applicable to fluid heat exchangers in general, i.e., both gases and liquids. Furthermore, the invention is applicable to round and oval tube fluid heat exchangers as well as the flat tube fluid heat exchanger shown in which case the apertures therefor in the header plates take the form of round or oval holes rather than slots. Moreover, the added ribs with the tube apertures therein according to the present invention may be used to provide improved tube lead in for ease of assembly even where load on the overhang is not a concern or where there is no overhang. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. A header plate for a pressure vessel, heat exchanger and the like, said plate having one side adapted to be exposed to one fluid and an opposite side adapted to be exposed to another fluid, said plate further having a first set of integral strengthening ribs, said plate further having a second set of integral strengthening ribs located between adjacent ones of the ribs in said first set, and the ribs in said second set each having one and only one tube receiving aperture therein and extending oppositely with respect to the ribs in said first set and adjoining the respective ribs in said first set so as to cooperatively extend their effective rib height.

2. A header plate for a pressure vessel, heat exchanger and the like, said plate having one side adapted to be exposed to one fluid and an opposite side adapted to be exposed to another fluid, said plate further having a first set of integral strengthening ribs each having a concave side on said opposite side and a convex side on said one side, said plate further having a second set of integral strengthening ribs located between adjacent ones of the ribs in said first set, the ribs in said second set each having a convex side on said opposite side and a concave side on said one side, the ribs in said second set adjoining the respective ribs in said first set so as to cooperatively extend their effective rib height, said plate further having one and only one tube receiving aperture in each of the ribs of said second set adapted to receive a tube, each said aperture being defined by a collar integral with the respective rib in said second set and extending outward on said opposite side, said plate having an overhang located outward of a region containing said aperture, and all of said ribs extending alongside and past the respective aperture and substantially across said overhang.

3. A header plate for a pressure vessel, heat exchanger and the like, said plate having one side adapted to be exposed to one fluid and an opposite side adapted to be exposed to another fluid, said plate further having a first set of integral channel shaped strengthening ribs extending parallel to each other and each having a concave side on said opposite side and a convex side of said one side, said plate further having a second set of integral channel shaped strengthening ribs extending parallel to each other and located between adjacent ones of the ribs in said first set, the ribs in said second set each having a convex side on said opposite side and a concave side on said one side, the ribs in said second set adjoining the respective ribs in said first set so as to cooperatively extend their effective rib height, the ribs in said second set each having a bump on their convex side, one and only one tube receiving aperture in each of the bumps on the ribs of said second set adapted to receive a tube, each said aperture being defined by the respective bump forming a collar integral with the respective rib in said second set and extending outward on said opposite side, said plate having an overhang located outward of a region containing said apertures, and all of said ribs extending alongside and past the respective apertures and substantially across said overhang.

4. A header plate for a pressure vessel, heat exchanger and the like, said plate having one side adapted to be exposed to one fluid and an opposite side adapted to be exposed to another fluid, said plate further having a first set of integral strengthening ribs, said plate further having a second set of integral strengthening ribs located between adjacent ones of the ribs in said first set, and the ribs in said second set each having a tube receiving aperture therein and extending oppositely with respect to the ribs in said first set and adjoining the respective ribs in said first set so as to cooperatively extend their effective rib height, said plate further having one and only one tube receiving aperture in each of the ribs of one of said sets adapted to receive a tube, each said aperture being defined by a collar integral with and extending outward from the respective rib in said one set, said plate having an overhang located outward of a region containing said apertures, and all of said ribs extending alongside and past the respective apertures and substantially across said overhang.

5. A header plate for a pressure vessel, heat exchanger and the like, said plate having one side adapted to be exposed to one fluid and an opposite side adapted to be exposed to another fluid, said plate further having a first set of integral strengthening ribs each having a concave side on said opposite side and a convex side on said one side, said plate further having a second set of integral strengthening ribs located between adjacent ones of the ribs in said first set, the ribs in said second set each having a convex side on said opposite side and a concave side on said one side, the ribs in said second set adjoining the respective ribs in said first set so as to cooperatively extend their effective rib height, said plate further having one and only one tube slot in each of the ribs of said second set adapted to receive a flat sided tube, each said tube slot being defied by a collar integral with the respective rib in said second set and extending outward on said opposite side, said plate having an overhang located outward of a region containing said slots, and all of said ribs extending alongside and past the respective slots and substantially across said overhang.

6. A header plate for a radiator, said plate having one side adapted to be exposed to air and an opposite side adapted to be exposed to a liquid, said plate further having a first set of integral channel shaped strengthening ribs extending parallel to each other and each having a concave side on said liquid side and a convex side on said air side, said plate further having a second set of integral channel shaped strengthening ribs extending parallel to each other and located between adjacent ones of the ribs in said first set, the ribs in said second set each having a convex side on said liquid side and a concave side on said air side, the ribs in said second set adjoining the respective ribs in said first set so as to cooperatively extend their effective rib height, the ribs in said second set each having a bump on their convex side, one and only one tube slot in each of the bumps on the ribs of said second set adapted to receive a flat sided tube, each said tube slot being defined by the respective bump forming a collar integral with the respective rib in said second set and extending outward on said liid side, said plate having an overhang located outward of a region containing said slots, and all of said ribs extending alongside and past the respective slots and substantially across said overhang.

* * * * *